US008029201B2

(12) United States Patent
Chen

(10) Patent No.: US 8,029,201 B2
(45) Date of Patent: Oct. 4, 2011

(54) REWINDING REEL FOR CARBON RIBBON/LABEL CARRIER OF LABEL PRINTER

(75) Inventor: Ching-Wen Chen, Taipei (TW)

(73) Assignee: TSC Auto ID Technology Co., Ltd., I-Lan Hsien (TW)

( * ) Notice: Subject to any disclaimer, the term of this patent is extended or adjusted under 35 U.S.C. 154(b) by 819 days.

(21) Appl. No.: 12/149,714

(22) Filed: May 7, 2008

(65) Prior Publication Data

US 2008/0279603 A1 Nov. 13, 2008

(30) Foreign Application Priority Data

May 8, 2007 (TW) ..... 96207363 U

(51) Int. Cl.
*B65H 75/00* (2006.01)
*B65H 75/24* (2006.01)
*B41J 15/00* (2006.01)

(52) U.S. Cl. ..... 400/242; 400/250; 400/614; 242/573.3; 242/573.7; 242/573.9

(58) Field of Classification Search ..... 400/242, 400/250, 612, 614; 242/570, 571, 571.8–573.9
See application file for complete search history.

(56) References Cited

U.S. PATENT DOCUMENTS 3,107,875 A * 10/1963 Gochenour et al. ..... 242/576
3,990,690 A * 11/1976 Lick ..... 269/48.1
4,079,896 A * 3/1978 Plach ..... 242/573
5,170,960 A * 12/1992 Pretto ..... 242/573
5,771,807 A * 6/1998 Moss ..... 101/375
6,095,704 A * 8/2000 Jaeger et al. ..... 400/613
6,494,401 B2 * 12/2002 Bradshaw et al. ..... 242/573.7
7,506,834 B2 * 3/2009 Lenkl ..... 242/573.7
2006/0090847 A1 * 5/2006 peirce ..... 156/344
2007/0034727 A1 * 2/2007 Kaya ..... 242/571.8

* cited by examiner

*Primary Examiner* — Judy Nguyen
*Assistant Examiner* — David Banh
(74) *Attorney, Agent, or Firm* — Rosenberg, Klein & Lee

(57) ABSTRACT

A rewinding reel for rewinding a carbon ribbon or a label carrier in a label printer is provided, including a shaft, a gear, at least two sliding bases, at least two outer casing members, a resilient element, and a knob. The gear is mounted to the shaft to mate a transmission of the label printer for driving rotation of the shaft. The sliding bases are mounted to the shaft and are rotatable by the shaft. The sliding bases include movable portions that form camming projections and follower projections respectively in camming engagement with follower projections and camming faces formed on the outer casing members to radially move the outer casing members away from and toward the sliding bases for expanding and contracting the outer casing members in order to selectively loosen the carbon ribbon or the label carrier wound around the outer casing members. The knob is fixed to the movable portions and is manually depressible to move the movable portions. The resilient element provides a biasing force that sets the movable portions at a position where the outer casing members expand.

9 Claims, 8 Drawing Sheets

REWINDING REEL FOR CARBON RIBBON/LABEL CARRIER OF LABEL PRINTER

BACKGROUND OF THE INVENTION

1. Field of the Invention

The present invention relates to a rewinding reel for rewinding a carbon ribbon or a label carrier in a label printer, and in particularly to a rewinding reel that is operable by manually depressing a knob to release or loosen the wound carbon ribbon or label carrier for easy removal thereof.

2. The Related Arts

A conventional label printer receives and fixes labels to be printed and a carbon ribbon for printing therein. The labels are carried by a carrier. The label carrier and the carbon ribbon must be rewound for collection after the printing operation is done and in this respect, rewinding reels are provided to rewind and collect the carbon ribbon and the label carrier. The conventional rewinding reel suffers difficulty of removal of the wound carbon ribbon or label carrier due to the tight engagement of the wound carbon ribbon or label carrier around the reel. Thus, the carbon ribbon or the label carrier must be removed forcibly and this causes certain problems and troubles to a user of the label printer. A conventional solution to this problem is to provide a paper spool as a base for rewinding and the paper spool together with the wound carbon ribbon or the label carrier is then disposed of together. This is also troublesome.

SUMMARY OF THE INVENTION

Thus, the present invention is aimed to provide a rewinding reel for rewinding and collecting used carbon ribbon or label carrier of a label printer in order to overcome the trouble of removing the wound carbon ribbon or label carrier of the conventional label printer.

An objective of the present invention is to provide a rewinding reel of a label printer, comprising movable portions that selectively expand/reduce outside diameter of outer casing members around which the used carbon ribbon or label carrier is wound to loosen the wound carbon ribbon or label carrier for easy removal thereof.

Another objective of the present invention is to provide a rewinding reel of a label printer that is operable by a manually depressible knob to selectively reduce outside diameter of outer casing members so as to loosen carbon ribbon or label carrier wound thereon for easy removal of the wound carbon ribbon or label carrier.

To achieve the above objectives, in accordance with the present invention, a rewinding reel is provided for rewinding a carbon ribbon or a label carrier in a label printer. The rewinding reel comprise a shaft, a gear, at least two sliding bases, at least two outer casing members, a resilient element, and a knob. The gear is mounted to the shaft to mate a transmission of the label printer for driving rotation of the shaft. The sliding bases are mounted to the shaft and are rotatable by the shaft. The sliding bases include movable portions that form camming projections and follower projections respectively in camming engagement with follower projections and camming faces formed on the outer casing members to radially move the outer casing members away from and toward the sliding bases for expanding and contracting the outer casing members in order to selectively loosen the carbon ribbon or the label carrier wound around the outer casing members. The knob is fixed to the movable portions and is manually depressible to move the movable portions.

The resilient element provides a biasing force that sets the movable portions at a position where the outer casing members expand. Thus, by manually depressing the knob, the outer casing members are contracted to allow easy removal of the carbon ribbon or the label carrier from the reel and the resilient element provides an automatic returning of the outer casing members back to an expanded condition for the next rewinding operation.

BRIEF DESCRIPTION OF THE DRAWINGS

The present invention will be apparent to those skilled in the art by reading the following description of preferred embodiment thereof, with reference to the attached drawings, wherein.

DETAILED DESCRIPTION OF THE PREFERRED EMBODIMENT

Figure 1:
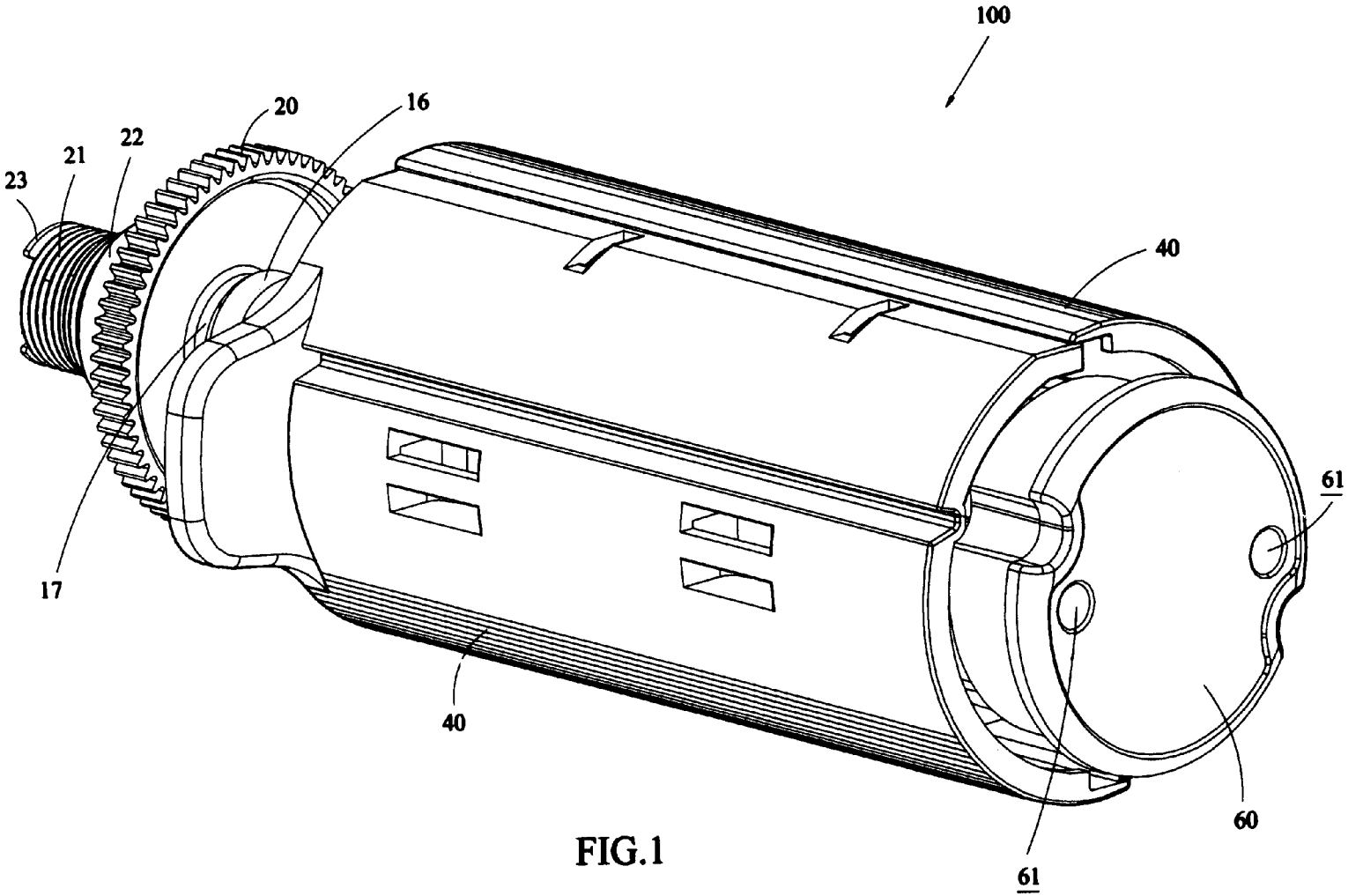
FIG. 1 is a perspective view of a rewinding reel constructed in accordance with the present invention for use with a label printer.
Figure 2:
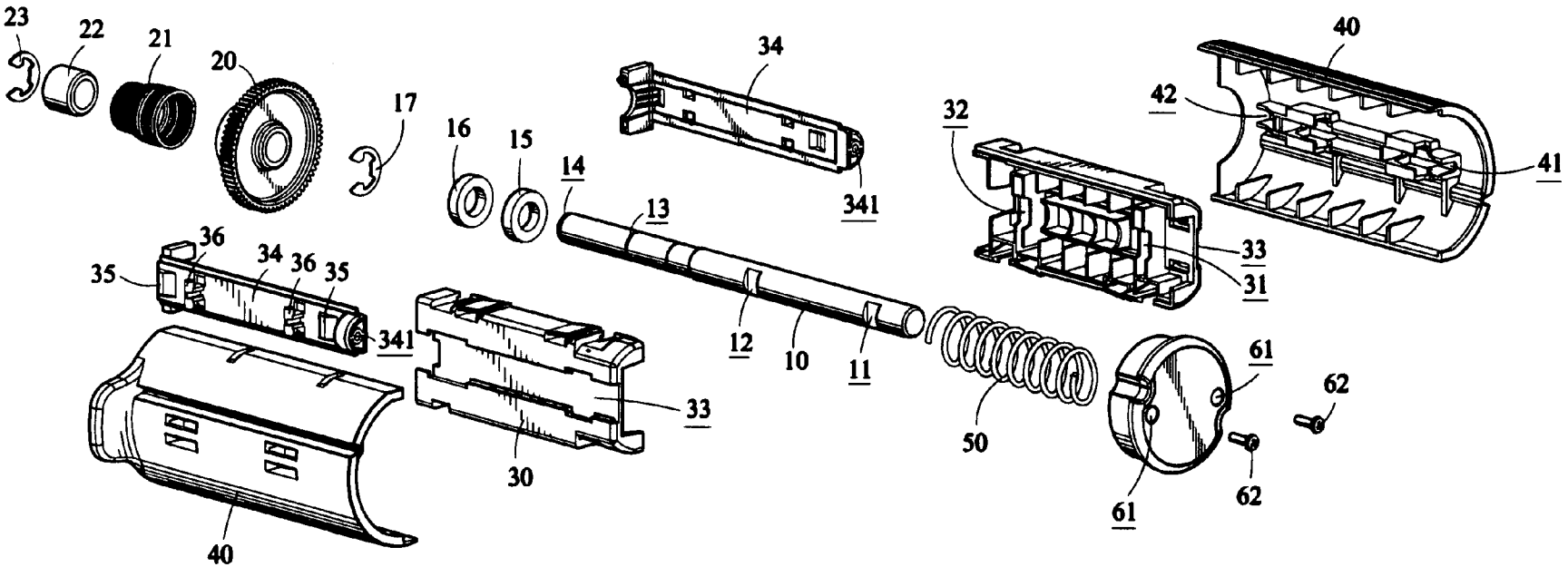
FIG. 2 is an exploded view of the rewinding reel of the present invention.
Figure 3:
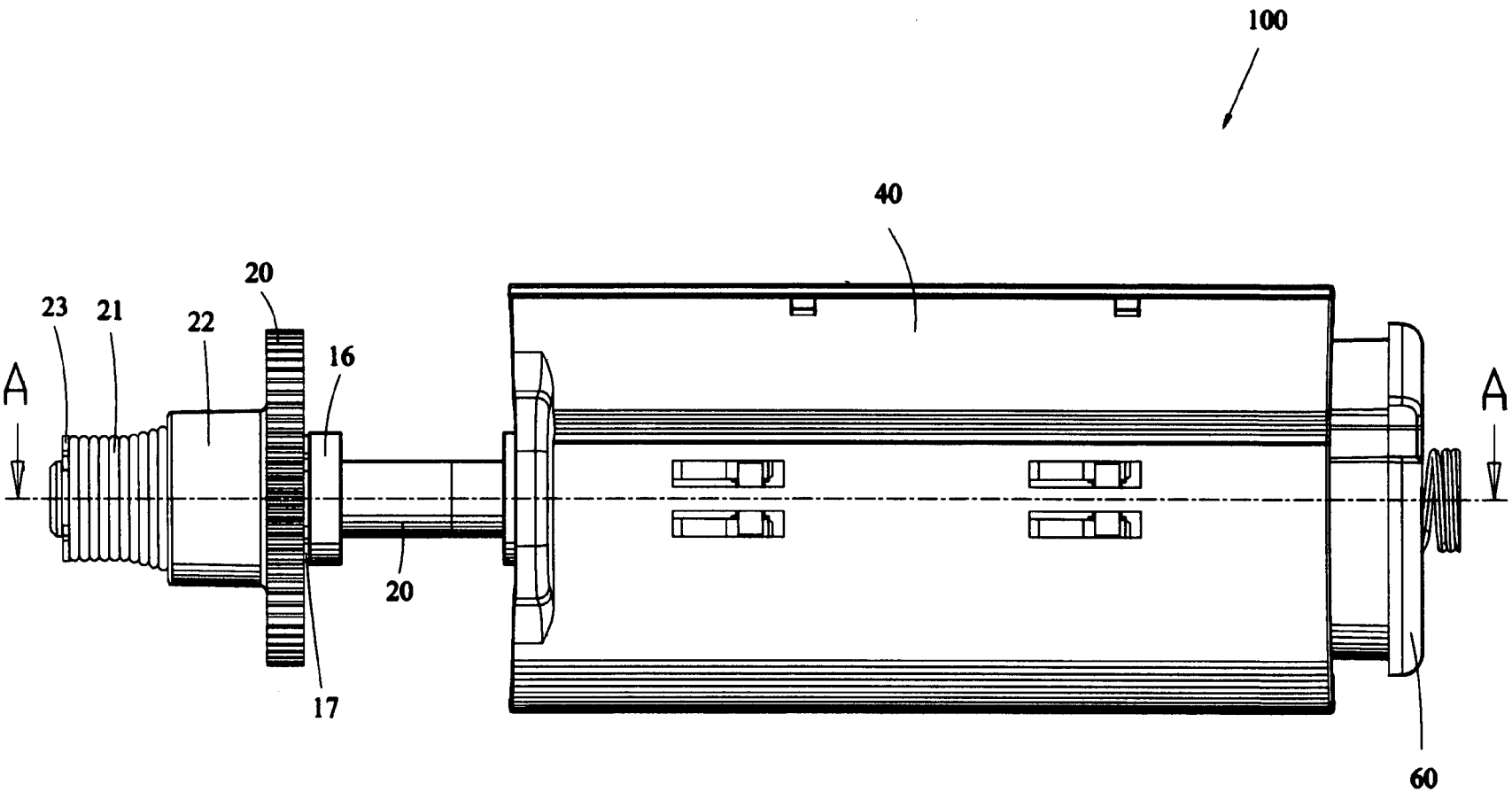
FIG. 3 is a side elevational view of the rewinding reel of the present invention.
Figure 4:
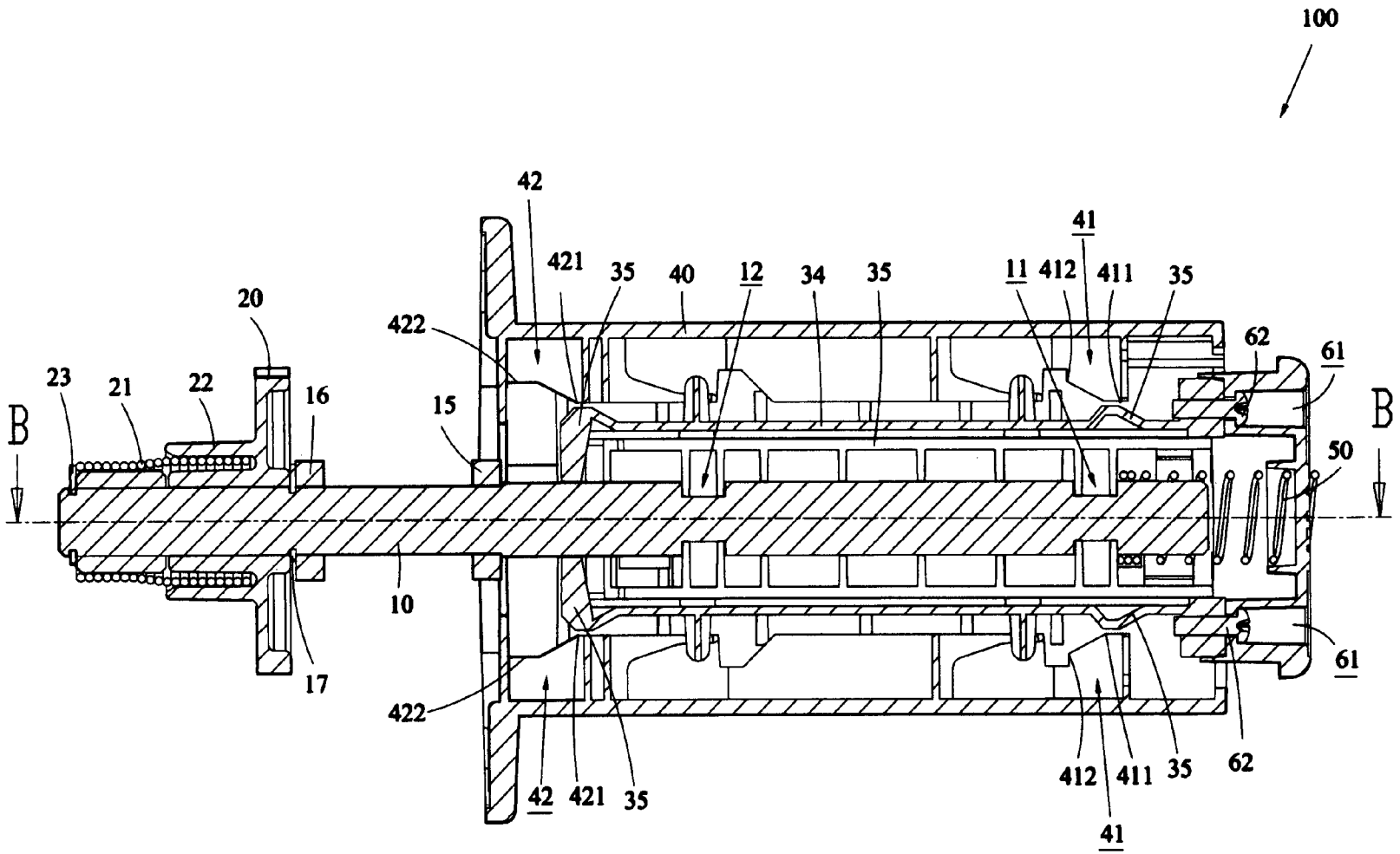
FIG. 4 is a cross-sectional view taken along line A-A of FIG. 3.
Figure 5:
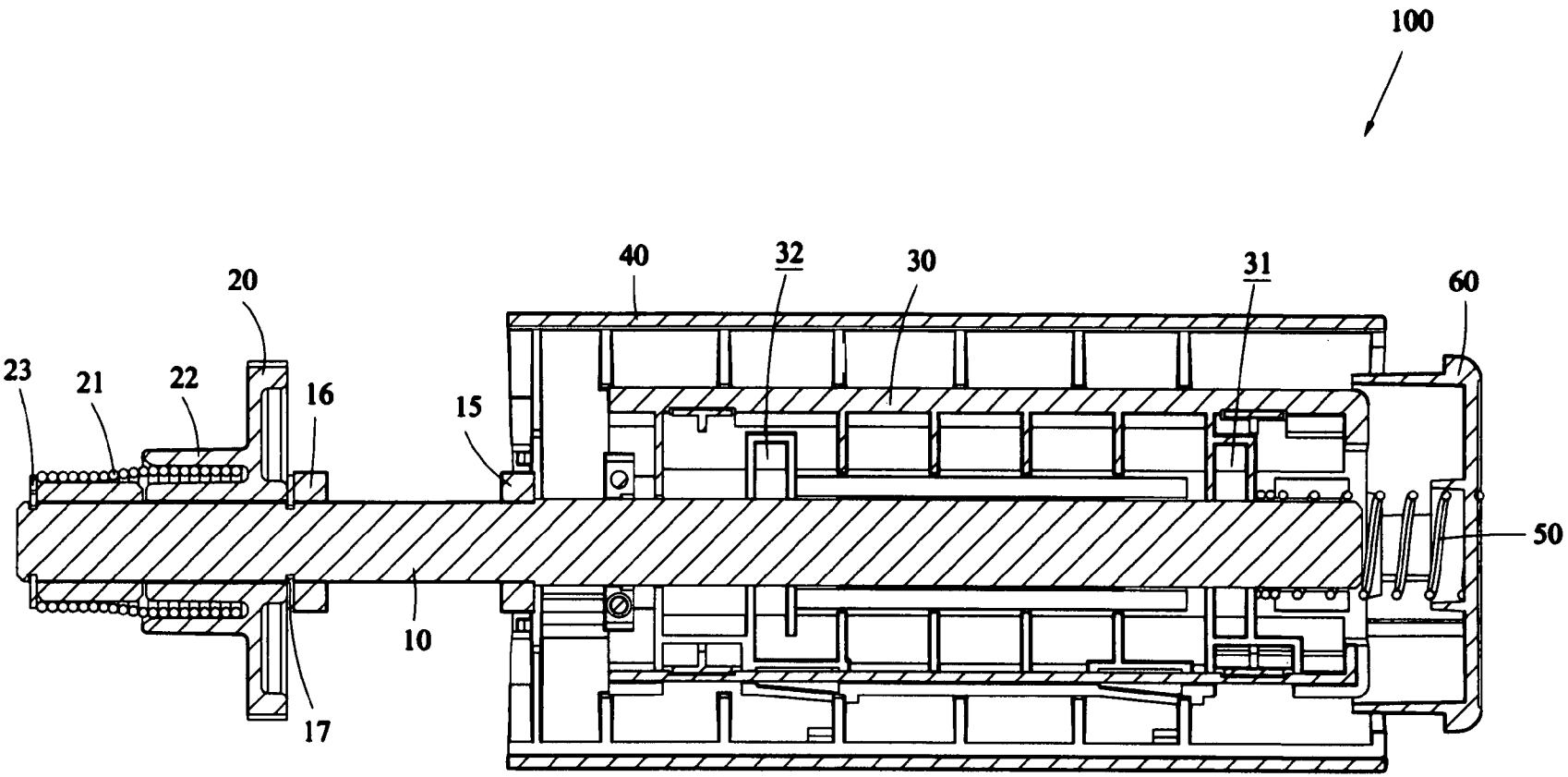
FIG. 5 is a cross-sectional view taken along line B-B of FIG. 4.

With reference to the drawings and in particular to FIGS. 1-5, which illustrate a rewinding reel, generally designated at 100, for rewinding a carbon ribbon or a label carrier in a label printer, the rewinding reel 100 comprises a shaft 10, a gear 20, at least one pair of sliding bases 30, at least a pair outer casing members 40, a resilient element 50, and a knob 60. The shaft 10 has a circumference having an inner end portion and an outer end portion respectively forming pairs of recesses 11, 12 and two axially-spaced circumferential grooves 13, 14. Two bearings 15 and 16 are fit on the inner end portion of the shaft 10 and a C-clip 17 is received and fixed in the axially inner groove 13 of the inner end portion of the shaft 10.

The gear 10 is mounted to the inner end portion of the shaft 10. Also mounted to the inner end portion of the shaft 10 are a torsional spring 21 and a one-way bearing 22. The gear 10, the torsional sprig 21 and the one-way bearing 22 are positioned between the grooves 13, 14 and are retained in position by the C-clip 17 that is fixed in the groove 13 and another C-clip 23 that is received and fixed in the axially outer groove 14. This arrangement allows the inner end portion of the shaft 10 to receive rotation/torque from a transmission 210 of the label printer 200 (see FIG. 7) with the gear 20 mating and driven by the transmission 210 by means of friction induced by the one-way bearing 22 and the torsional spring 21, in order to ensure proper tension in rewinding the carbon ribbon or the label carrier.

The sliding bases 30 have inner side opposing the shaft 10 and forming fitting portions 31, 32, which are respectively fit into the recesses 11, 12 of the shaft 10 so that the slides 30 can be rotated by the rotation of the shaft 10. The sliding base 30 has an outer side opposite to the inner side thereof and forming a channel 33 in which a movable panel 34 is movably received so that the panel 34 is axially slidable in the channel 33 of the sliding base 30. The movable panel 34 forms an inner-threaded hole 341. The movable panel 34 also forms, on an outside surface thereof, expanding camming projections 35 and contracting follower projections 36.

If desired, the sliding bases 30 can be integrated with the shaft 10.

Each outer casing member 40 corresponds to one of the movable panel 34 and are arranged outside the sliding base 30 and the movable panel 34. The outer casing member 40 has an inner side forming follower projections 41, 42 mating the expanding camming projections 35 of the movable panel 34. Each follower projection 41, 42 has a most-projecting point 411, 421 and a least-projecting point 412, 422, which are considered "highest" point and "lowest" point with respect to the outer casing member 40. Also, the outer casing member 40 forms camming faces (not labeled) on the inner side thereof to mate the contracting followers 36 of the movable panel 34. Thus, when the movable panel 34 is moved between first and second positions, the camming engagement between the expanding camming projections 35 of the movable panel 34 and the follower projections 41, 42 of the outer casing member 40 selectively works to expand the outer casing member 40 or more particularly, to radially move the outer casing member 40 away from the movable panel 34 by a distance (this being set in association with the first position of the movable panel 34 in the embodiment illustrated), and the camming engagement between the contracting follower projections 36 of the movable panel 34 and the camming faces of the outer casing member 40 selectively works to contract the outer casing member 40 or more particularly to radially move the outer casing member 40 close to the sliding base 30 and the movable panel 34 (this being set as the second position of the movable panel 34). The expanding and contracting camming operations are put into forces in an alternate manner so that the outer casing member 40 can be selectively and alternately set at a distant position or a close position with respect to the shaft 10.

In the embodiment illustrated, the camming projection 35 of the panel 34 and the follower projection 41, 42 of the outer casing member 40 both form slopes that are complementary to each other and the camming face of the outer casing member 40 also forms a slope substantially corresponding to that of the follower projection 41, 42, but facing outward and the follower projection 36 of the panel 34 has an inverted L-shaped configuration having a tail forming the camming engagement with the camming face of the outer casing member 40. However, it is apparent that these can be replaced by any equivalent constructions.

The resilient element 50 is fit to the outer end portion of the shaft 10 and can be of any kind of resilient member that offers a biasing force. A spring is taken as an example for the resilient element 50 in the embodiment illustrated.

The knob 60, serving as a depressible button, forms two through holes 61 corresponding to the inner-threaded holes 341 of the two movable panels 34. Bolts 62 extend through the holes 61 of the knob 60 and engage the inner-threaded holes 341 of the movable panels 34 to fix the knob 60 to the movable panels 34. Thus, depression of the knob 60 with respect to the outer end of the shaft 10 causes the movable panels 34 to move from the first position (FIG. 4) to the second position (FIG. 8), resulting in contracting of the outer casing members 40. The resilient element 50 provides a biasing force that biases the knob 60 and the panels 34 to the first position and thus serving as a returning force that automatically moves the knob 60 and the panels 34 from the second position to the first position when the knob 60 is released from depression.

Figure 6:
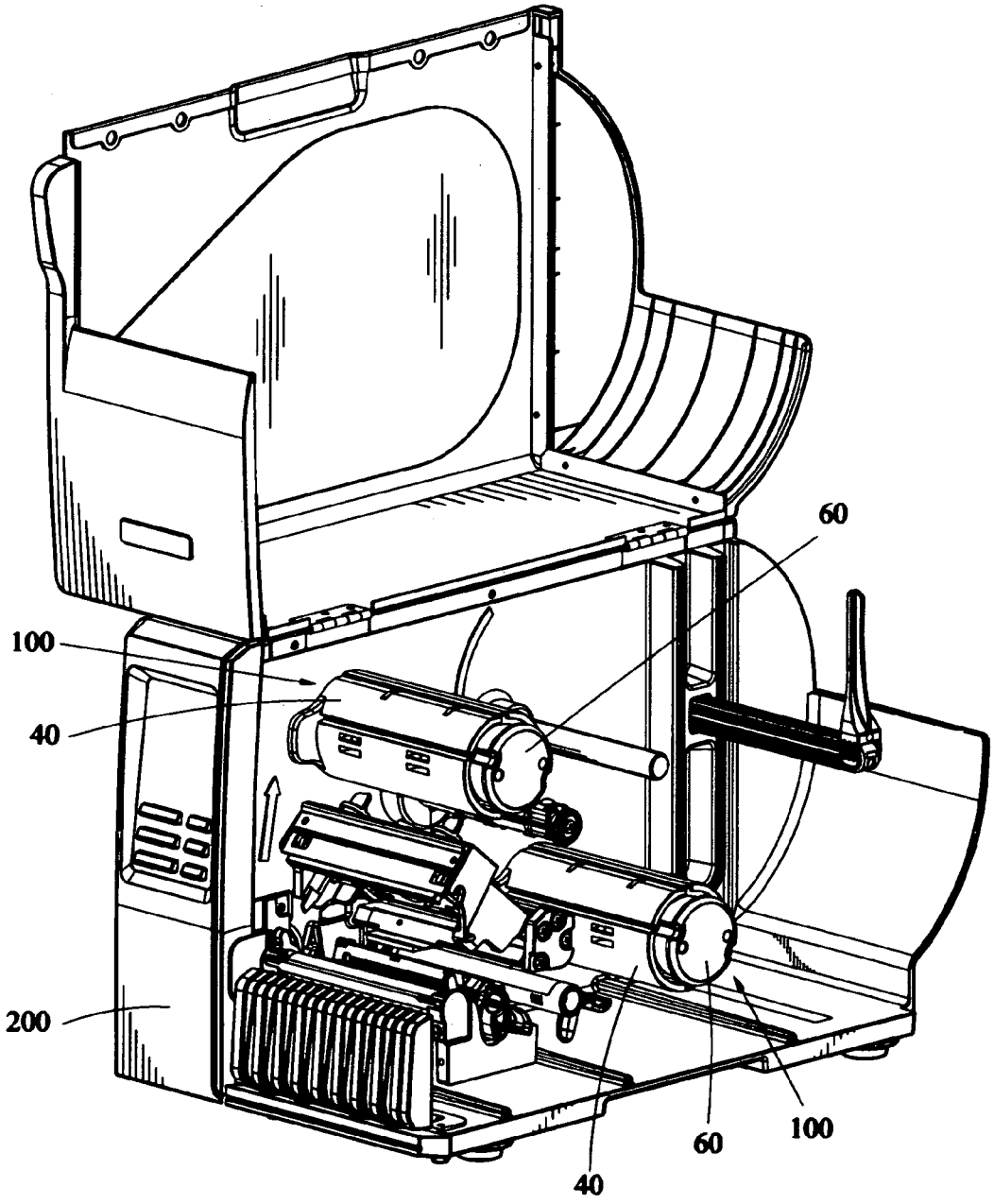
FIG. 6 is a perspective view illustrating of a label printer in which the rewinding reel of the present invention is applied.
Figure 7:
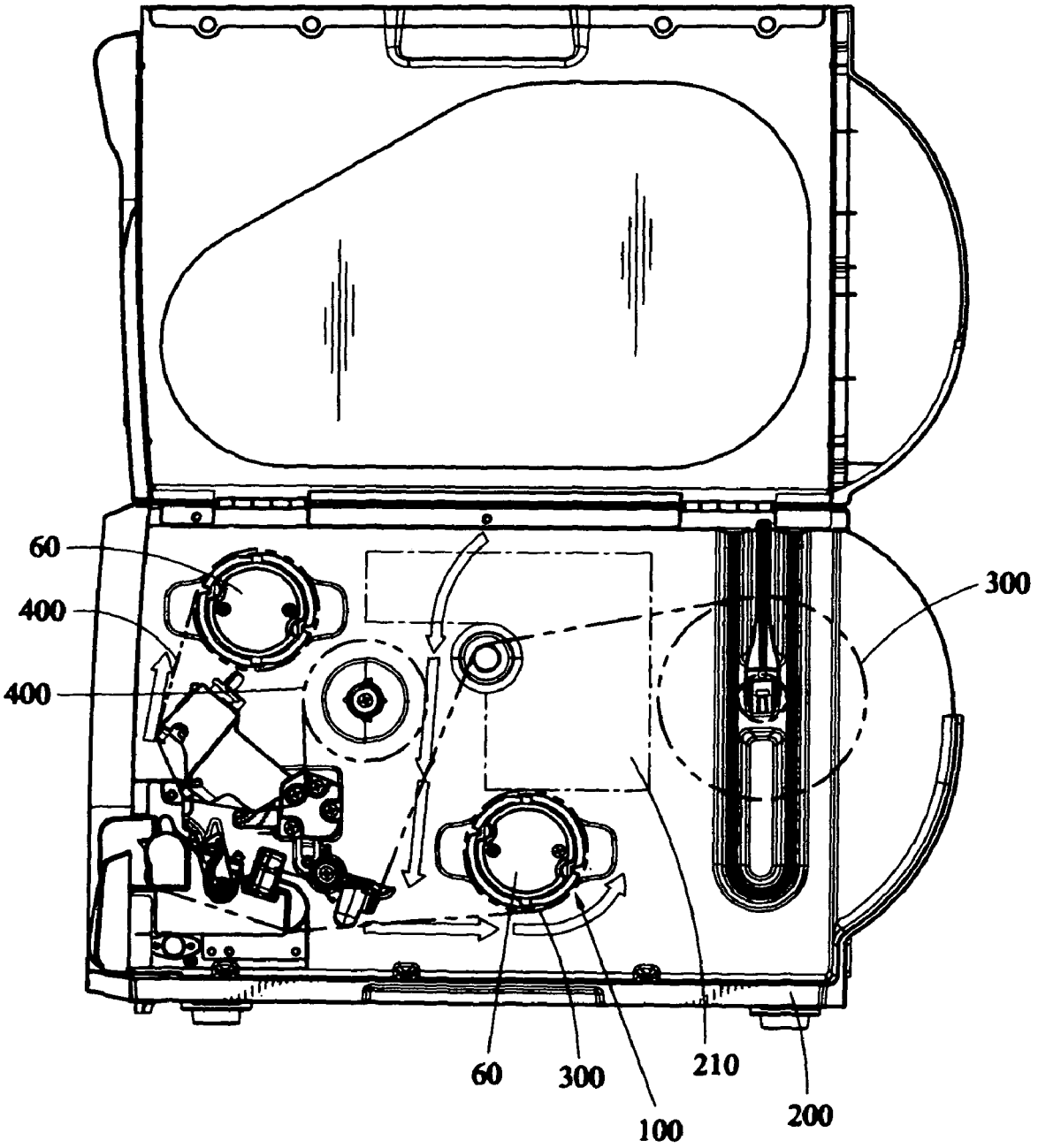
FIG. 7 is a front view of FIG. 6.

Also referring to FIGS. 6 and 7, the rewinding reel 100 is mounted in the label printer 200 to rewind and thus collect a label carrier 300 or a carbon ribbon 400. The gear 20 is put in driving engagement with the transmission 210 of the label printer 200 for driving rotation of the rewinding reel 100.

Figure 8:
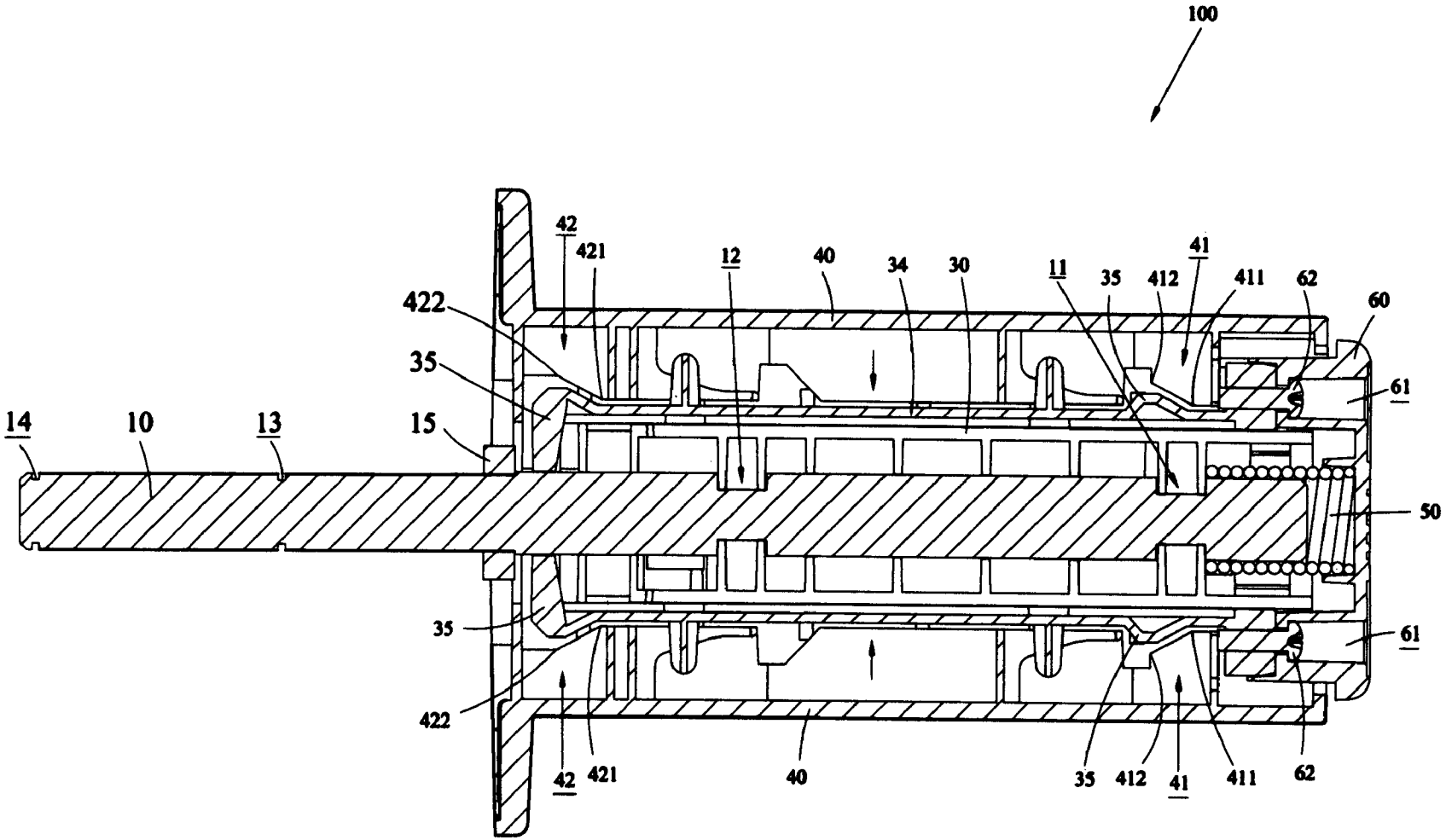
FIG. 8 is a cross-sectional view similar to FIG. 4, illustrating the operation of the rewinding reel of the present invention.

Also referring to FIG. 8, when the rewinding reel 100 is put into operation for a period of time so that the rewinding reel 100 is full of the label carrier 300 or the carbon ribbon 400, an operator may manually depress the knob 60, causing the panels 34 to move from the first position to the second position (namely moving in the leftward direction as viewed in the drawings). The expanding camming projections 35 are thus moved from the most-projecting points 411, 421 of the follower projections 41, 42 to the least-projecting points 421, 422 of the follower projections 41, 42, and also due to the camming engagement between the camming faces of the outer casing members 40 and the contracting follower projections 36, the outer casing members 40 are moved inward and getting close to the panels 34, which means the outer casing members 40 contract and the outside diameter defined by the outer casing members 40 is reduced so that the outside diameter of the outer casing members 40 is smaller than an inside diameter of a spool of the label carrier 300 or the carbon ribbon 400 that is fit over the rewinding reel 100. Consequently, the label carrier 300 or the carbon ribbon 400 that was originally tightly wrapping around the outer casing members 40 is released and can be easily removed from the outer casing members 40.

Once the rewound label carrier 300 or carbon ribbon 400 is removed, the knob 60 is released and the resilient element 50 automatically returns the panels 34 back to the first position and the camming engagement between the expanding camming projections 35 and the follower projections 41, 42, the outer casing members 40 are forced to expand and thus increasing the outside diameter thereof for the next rewinding operation of the carbon ribbon 400 or the label carrier 300.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A rewinding reel for use in a label printer to rewind a continuous medium of the label printer, comprising: a shaft having a circumference forming a plurality of recesses;

a gear mounted to the shaft and adapted to provide a driving coupling between the shaft and a transmission of the label printer through a one-way bearing and a torsional spring in order induce rotation of the shaft to rewind the continuous medium with a tension set by friction between the torsional spring and the gear;

sliding bases having inner sides forming fitting portions fit into the recesses of the shaft so that the sliding bases are rotatable by the rotation of the shaft, the each sliding base having a movable portion that forms a first projection;

outer casing members arranged outside the sliding bases to receive the continuous medium surrounding thereon, each outer casing member having an inner side forming a second projection corresponding to the first projection and having a highest point and a lowest point to allow the first projection to move between the highest and lowest points;

a resilient element arranged at an end of the shaft opposite to the transmission of the label printer, and providing a biasing force to set the first projection at the highest point of the second projection; and a knob coupled to the movable portions of the sliding bases to selectively move the movable portions between first and second positions where the first projection is set at the highest and lowest points of the second projection to thereby allow for selective expansion and contraction of the outer casing members with respect to the sliding bases, respectively, to selectively release the continuous medium from the outer casing members wherein the movable portion of the sliding base comprises a movable panel movably received in a channel to be movable, together with the knob, between the first and second positions formed within the channel.

2. The rewinding reel as claimed in claim 1, wherein the shaft forms grooves to receive and fix retention elements that retains the gear, the torsional spring and the one-way bearing in position.

3. The rewinding reel as claimed in claim 1 further comprising a bearing mounted to the shaft.

4. The rewinding reel as claimed in claim 1, wherein each sliding base forms a channel.

5. The rewinding reel as claimed in claim 1, wherein each movable panel forms an inner-threaded hole.

6. The rewinding reel as claimed in claim 5, wherein the knob forms a through hole corresponding to the inner-threaded hole of each movable panel to receive a threaded fastener that engages the inner-threaded hole of the movable panel to thereby fix the movable panel to the knob.

7. The rewinding reel as claimed in claim 1, wherein the movable panel forms a projection that forms a follower and wherein the outer casing member forms a camming face engageable with the follower to provide camming operation for contracting the outer casing member.

8. The rewinding reel as claimed in claim 1, wherein the first and second projections form camming engagement therebetween to provide a camming operation for expanding the outer casing member by the biasing force of the resilient element.

9. The rewinding reel as claimed in claim 1, wherein resilient element comprises a spring.

* * * * *